US009759384B2

(12) United States Patent
Frenal et al.

(10) Patent No.: US 9,759,384 B2
(45) Date of Patent: Sep. 12, 2017

(54) GAS SUPPLY DEVICE

(71) Applicant: L'Air Liquide, Société Anonyme pour l'Etude et l'Exploitation des Procédés Georges Claude, Paris (FR)

(72) Inventors: Antoine Frenal, Ezanville (FR); Denis Muller, Rueil Malmaison (FR); Didier Robert, Lyons (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 15/023,288

(22) PCT Filed: Sep. 5, 2014

(86) PCT No.: PCT/FR2014/052196
§ 371 (c)(1),
(2) Date: Mar. 18, 2016

(87) PCT Pub. No.: WO2015/040303
PCT Pub. Date: Mar. 26, 2015

(65) Prior Publication Data

US 2016/0230935 A1 Aug. 11, 2016

(30) Foreign Application Priority Data

Sep. 19, 2013 (FR) ..... 13 59018

(51) Int. Cl.
*F17C 13/08* (2006.01)
*F17C 13/04* (2006.01)

(52) U.S. Cl.
CPC ..... *F17C 13/084* (2013.01); *F17C 13/04* (2013.01); *F17C 2201/0109* (2013.01);
(Continued)

(58) Field of Classification Search
CPC ..... F17C 2205/0107; F17C 2205/0111; F17C 2205/0329; F17C 13/084; Y10T 137/7043; Y10T 137/7062; Y10T 137/7039
See application file for complete search history.

(56) References Cited

U.S. PATENT DOCUMENTS 4,542,774 A * 9/1985 Stavlo ..... B60P 3/2265 141/1
4,967,934 A * 11/1990 Andonian ..... F17C 13/085 137/266

(Continued)

FOREIGN PATENT DOCUMENTS

DE 1961 9779 11/1996
DE 2010 3682 5/2001

(Continued)

OTHER PUBLICATIONS

French Search Report for FR1359018 mailed Jul. 14, 2014.

(Continued)

*Primary Examiner* — Kevin Murphy
(74) *Attorney, Agent, or Firm* — Elwood L. Haynes

(57) ABSTRACT

The invention relates to a gas supply device including a supporting frame (2) housing a plurality of cylinders (3) connected such as to form a circuit (4, 5) including a first coupling end (6) connected to the cylinders (3) via a first isolation valve (7) and a second separate coupling end (8) that is connected to the cylinders (3) via a second isolation valve (9) and a pressure release valve (10), the supporting frame (2) including an interface panel (20) comprising at least one opening enabling a user to access the circuit (4, 5), characterized in that the device comprises a member (16) for manually controlling the second isolation valve (9) including a pivoting lever, and in that the interface panel (20) includes a slot (21) for accessing the lever (16), said lever
(Continued)

(16) being movable between a first position in which the lever (16) is in the plane of the interface panel (20) or set back from the latter within the volume of the frame (2) and a second position in which at least one portion of the lever (16) projects relative to the interface panel (20) through the slot (21).

10 Claims, 4 Drawing Sheets

(52) U.S. Cl.
CPC .. *F17C 2201/032* (2013.01); *F17C 2201/056* (2013.01); *F17C 2201/058* (2013.01); *F17C 2205/0107* (2013.01); *F17C 2205/0142* (2013.01); *F17C 2205/0146* (2013.01); *F17C 2205/037* (2013.01); *F17C 2205/0323* (2013.01); *F17C 2205/0329* (2013.01); *F17C 2205/0332* (2013.01); *F17C 2205/0335* (2013.01); *F17C 2205/0338* (2013.01); *F17C 2205/0385* (2013.01); *F17C 2223/0123* (2013.01); *F17C 2223/036* (2013.01); *F17C 2227/046* (2013.01); *F17C 2227/048* (2013.01); *F17C 2250/043* (2013.01); *F17C 2260/028* (2013.01); *F17C 2265/025* (2013.01); *Y10T 137/7043* (2015.04); *Y10T 137/7062* (2015.04)

(56) References Cited

U.S. PATENT DOCUMENTS 5,078,415 A * 1/1992 Goral ..... B62B 3/104 108/55.1
5,404,921 A * 4/1995 Lamoreaux ..... B63C 11/02 141/145
5,975,121 A 11/1999 Arzenton et al.
7,070,372 B2 * 7/2006 Denike ..... F17C 13/084 211/85.18
8,016,300 B2 * 9/2011 Cramer ..... B62B 5/049 137/899.3
2008/0110784 A1 * 5/2008 Nowicki ..... F17C 13/084 206/446
2009/0283351 A1 * 11/2009 Cannet ..... F17C 7/00 180/302
2011/0049194 A1 * 3/2011 Cannet ..... F17C 13/04 137/382
2012/0175375 A1 7/2012 Ligonesche et al.
2012/0261425 A1 10/2012 Lang et al.
2014/0026991 A1 1/2014 Verghade et al.
2014/0290797 A1 10/2014 Kriese et al.

FOREIGN PATENT DOCUMENTS

DE 20 2004 000771 4/2004
DE 10 2011 014 065 9/2012
DE 10 2012 004391 9/2013
FR 2 735 209 12/1996
FR 2 828 922 2/2003
FR 2 970 314 7/2012
FR 2 985 802 7/2013
GB 2 007 348 5/1979

OTHER PUBLICATIONS

International Search Report and Written Opinion for PCT/FR2014/052196 mailed Nov. 14, 2014 (with English translation).

* cited by examiner

GAS SUPPLY DEVICE

CROSS REFERENCE TO RELATED APPLICATIONS

This application is a 371 of International PCT Application PCT/FR2014/052196 filed Sep. 5, 2014, which claims priority to French Patent Application No. 1359018 filed Sep. 19, 2013, the entire contents of which are incorporated herein by reference.

BACKGROUND

The present invention relates to a device for supplying gas.

The invention relates more particularly to a device for supplying gas comprising a support frame housing a plurality of pressurized-gas cylinders connected to a fluid circuit for withdrawing from or filling the cylinders, said circuit comprising a first connection end connected to the cylinders via a first isolation valve to allow filling of and withdrawing from the cylinders and a second connection end which is distinct and is connected to the cylinders via a second isolation valve and a pressure regulator so as to allow fluid to be withdrawn, the support frame comprising, on one of its faces, an interface panel comprising at least one opening providing a user access to the circuit.

The invention notably relates to gas supply devices sometimes referred to as "frames".

Such a device is described for example in documents DE20103682U1, GB2007348 A1 or DE102011014065 A1.

Such devices generally use an array of cylinders storing gas at high pressures, for example 200 bar, 300 bar or above.

These devices need to meet various, and often conflicting, requirements, for example: a cylinder filling circuit compatible with high flow rates and pressures and allowing satisfactory mixing of gas (in terms of homogeneity and/or filling time in particular), a withdrawing circuit that offers safety of use for the user, ergonomic use and prevents incorrect handling.

SUMMARY

One object of the present invention is to alleviate all or some of the prior art disadvantages listed above.

To this end, the device for supplying gas according to the invention, in other respects in accordance with the generic definition given thereof in the above preamble, is essentially characterized in that the device comprises a control member for manually operating the second isolation valve and comprising a pivoting lever, and in that the interface panel comprises a slot providing access to the lever, said lever being mobile through the slot between a first position in which the lever is situated in the plane of the interface panel or set back therefrom within the frame volume and a second position in which at least part of the lever projects with respect to the interface panel toward the outside of the frame and through the slot.

Moreover, some embodiments of the invention may include one or more of the following features:

- the lever comprises a body in the overall form of a rod the free end of which has a head that is enlarged in comparison with the rest of the body, and in that, in its second position, the head of the lever projects with respect to the interface panel through the slot,
- the slot has an overall shape corresponding to the shape of the outline of the lever,

- the device comprises a guarantee seal which, in a first configuration, has a first end fixed to the panel and a second end fixed to the lever placed in its first position, the seal in its first configuration forming an end stop preventing the lever from moving from the first to its second position, the seal comprising a rupture zone configured for manually placing the seal in a second configuration in which the connection attaching the seal to the interface panel and/or to the lever is broken,
- the seal has the form of a flat tab and comprises an end for grasping,
- the lever comprises a zone of weakness such as a local reduction in thickness to make it easier to break in the event of a knock and to limit the force transmitted to the second valve,
- the first connection end comprises a filling coupling situated facing the interface panel, said panel comprising a first opening for accessing the first connection end,
- the device comprises a mobile cover for opening or closing the first opening,
- the second connection end comprises a withdrawing coupling situated facing the interface panel, said panel comprising a second opening for accessing the second connection end,
- the circuit comprises a pressure gauge situated facing the interface panel, said panel comprising a third opening for accessing the pressure gauge.

The invention may also relate to any alternative device or method including any combination of the features listed hereinabove or hereinbelow.

BRIEF DESCRIPTION OF THE DRAWINGS

Other specifics and advantages will become apparent from reading the description hereinafter, given with reference to the figures in which.

DESCRIPTION OF PREFERRED EMBODIMENTS

Figure 1:
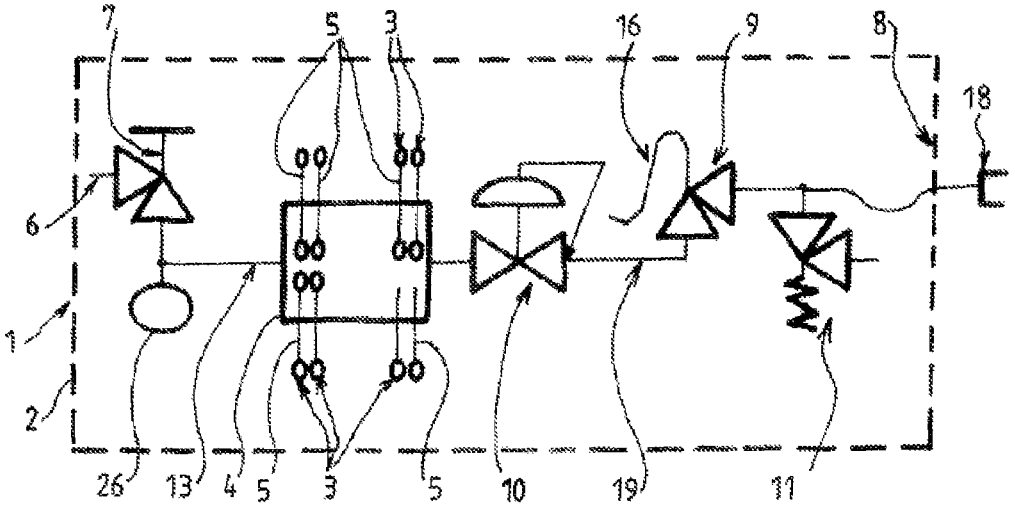
FIG. 1 is a schematic and partial view illustrating the structure of one possible embodiment of the invention.
Figure 2:
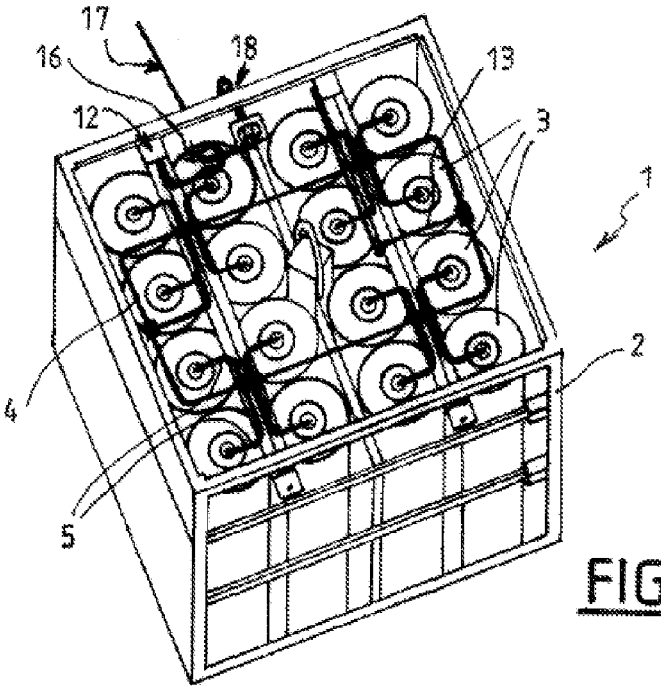
FIG. 2 is a perspective view from above of one possible embodiment of the device according to the invention.
Figure 3:
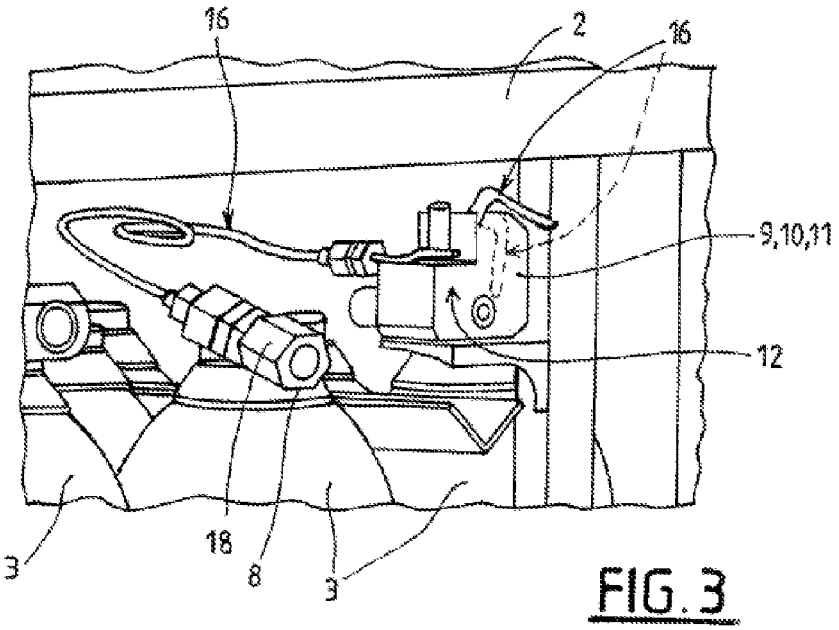
FIG. 3 is a perspective view of a detail of FIG. 3 notably illustrating a valve of the device.

The gas supply device 1 illustrated in FIGS. 1 to 3 comprises in the conventional way a support frame 2 comprising, for example, a parallelepipedal framework housing a plurality of pressurized-fluid cylinders 3.

For example, the cylinders 3 are arranged in an array vertically on a bottom (sixteen cylinders 3 in this nonlimiting example). The orifices of the cylinders 3 are connected to a fluid circuit 4, 5 for withdrawing from or filling the cylinders 3.

The circuit 4, 5 comprises a first connection end 6 connected to the cylinders 3 via a first isolation valve 7 to allow filling of and withdrawing from the cylinders 3. The circuit comprises a distinct second connection end 8 connected to the orifices of the cylinders 3 via a second isolation valve 9 and a pressure regulator 10.

As illustrated by way of example in FIG. 1, the regulator 10 and the isolation valve 9 are arranged in series in that order between the cylinders 3 and the second connection end 8. Of course, it is possible to plan to position the second isolation valve 9 upstream of the regulator 10 (namely between the cylinders 3 and the regulator 10). The second connection end 8 is there to allow fluid to be withdrawn.

The support frame 2 comprises on one of its faces, referred to as the "front face", an interface panel 20 for a user and comprising at least one opening for accessing the circuit 4, 5.

The device comprises a control member 16 for manual operation of the second isolation valve 9 comprising a pivoting lever. For example, although this is nonlimiting, the control lever 16 and its associated valve may have all or some of the features of the devices described in the documents FR2735209A1, FR2828922A1 or FR2970314A1.

Figure 5:
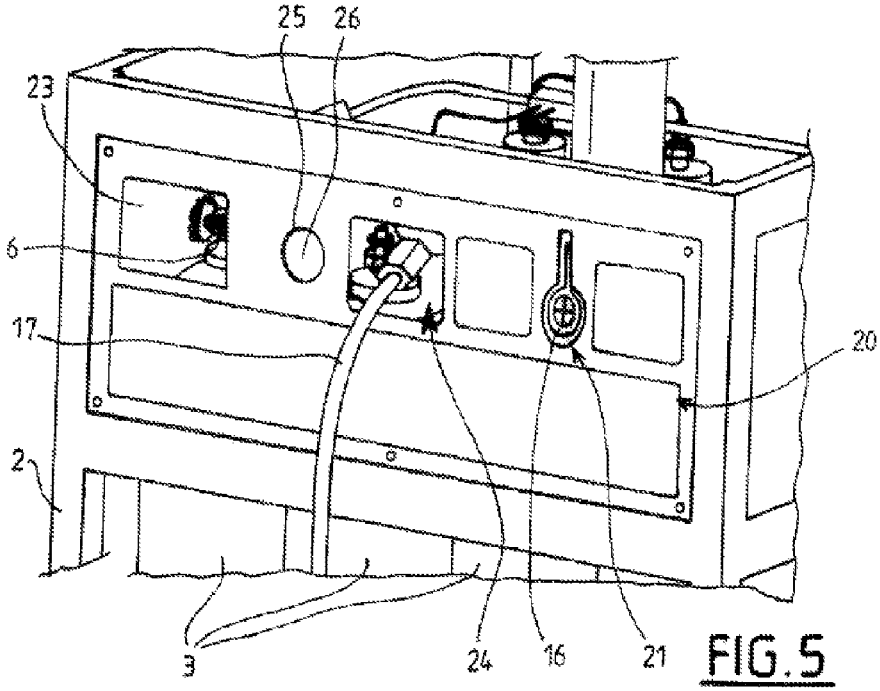
FIG. 5 is a view similar to that of FIG. 4 in a second configuration of use.
Figure 6:
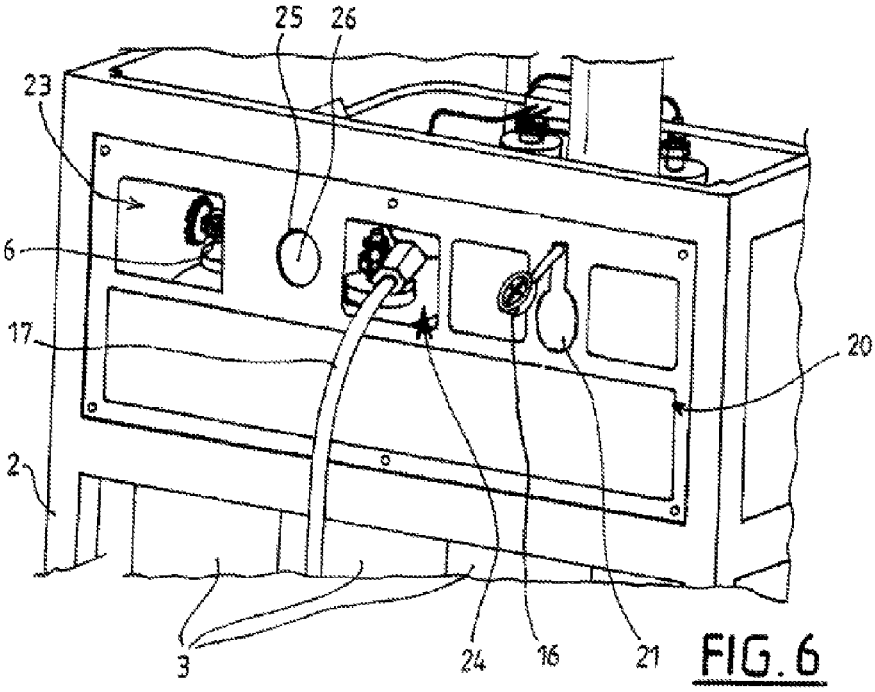
FIG. 6 is a view similar to that of FIG. 4 in a third configuration of use.
Figure 7:
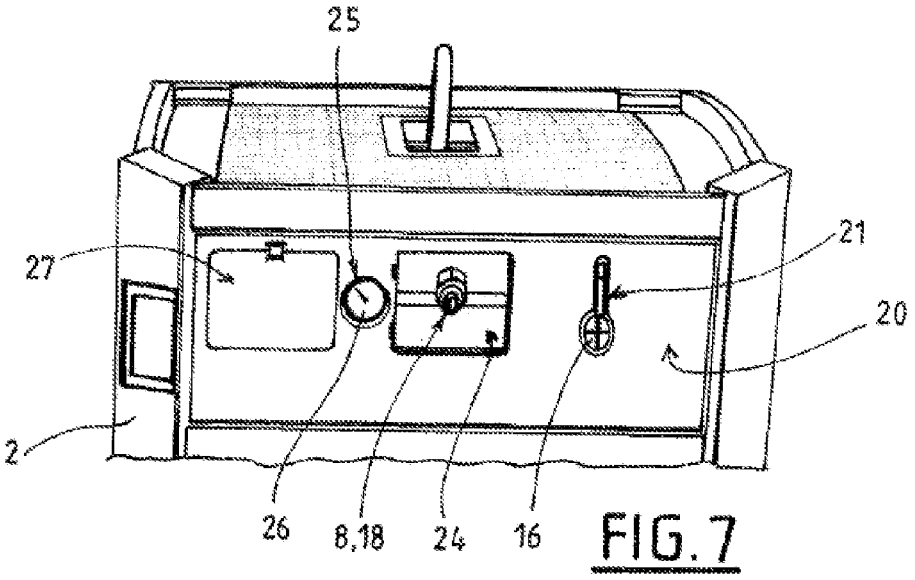
FIG. 7 is a perspective view of a detail of the front face of the device of FIG. 3 in a fourth configuration of use.

In addition, the interface panel 20 comprises a slot 21 for accessing the lever 16. The lever 16 can rotate at one of its ends on a valve body or tap body. The lever 16 is notably able to move through the slot 21 between a first position in which the lever 16 is situated in the plane of the interface panel 20 or set back therefrom within the volume of the frame 2 (cf. FIGS. 5 and 7) and a second position in which at least part of the lever 16 projects with respect to the interface panel 20 toward the outside of the frame 2 and through the slot 21 (cf. FIG. 6).

What that means to say is that, in its first position, the lever 16 can be in the plane of the interface panel 20 or set back therefrom inside the volume of the frame 2. In its second position, the terminal end at least of the lever 16 projects with respect to the panel 20 toward the outside of the frame 2.

The first position preferably corresponds to a command to close the first isolation valve 7 whereas in the second position, the lever commands the opening of the first isolation valve 7.

This configuration provides the user with visual information regarding the open/closed status of the isolation valve 9 (visible from a distance of several meters).

As illustrated in FIG. 3, the lever 16 may have the overall form of a rod (in FIG. 3 the lever has been depicted in two, respectively down and up, extreme positions simultaneously). As an alternative, and as illustrated in FIGS. 4 to 7, the lever 16 may comprise a body with the overall form of a rod the free end of which comprises a head that is enlarged with respect to the rest of the body. Thus, in its second position, the head of the lever 16 projects with respect to the interface panel 20 through the slot 21. For example, the head of the lever 16 has the form of a ring which, at its center, may comprise crossed ribs.

Of course, the lever 16 may have any other suitable shape.

For preference, the slot 21 has an overall shape corresponding to the shape of the outline of the lever 16 (with, for example, a clearance of a few millimeters or centimeters between the edge of the lever 16 and the edge of the slot 21.

Figure 4:
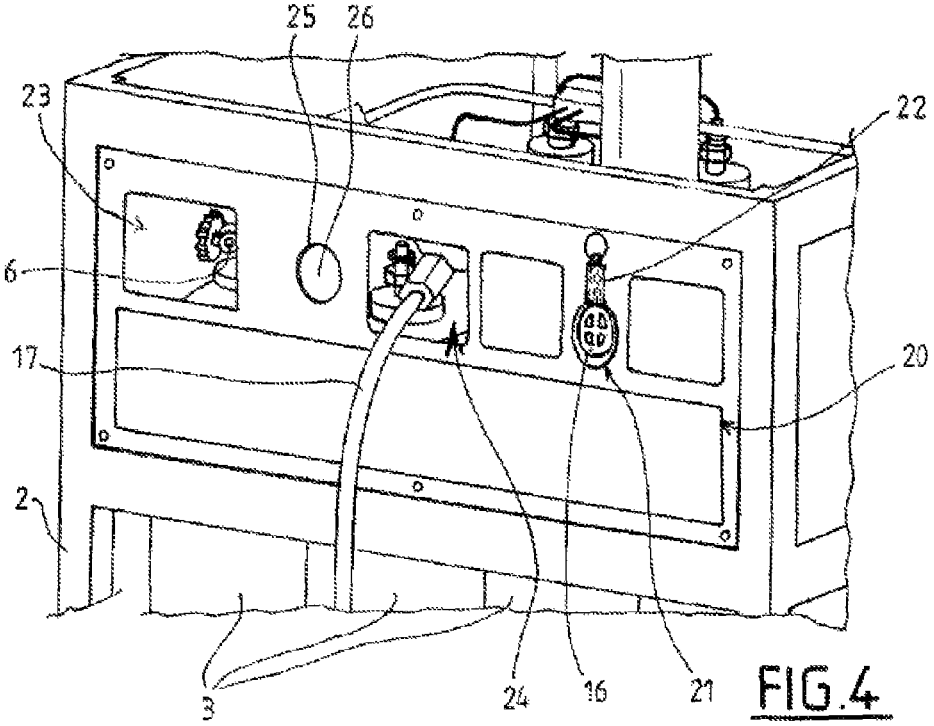
FIG. 4 is a schematic and partial perspective view illustrating a detail of the front face of the device of FIG. 2 in a first configuration of use.

As illustrated in FIG. 4, when the lever 16 is in its first position, for example when the device is delivered, a guarantee seal 22 may be provided to guarantee that the device has not been used after the filling of the cylinders 3.

The guarantee seal 22 has, for example, the form of a flat tab and comprises an end for manual grasping.

In its first configuration corresponding to FIG. 4 (seal 22 not removed), a first end of the seal 22 is fixed to the panel 20 at the slot 21 and a second end of the seal is fixed to the lever 16 situated in its first position. In this first configuration, the seal 22 forms a mechanical end stop preventing the lever 16 from moving from the first to its second position.

The seal 22 is fixed to the panel 20 and to the lever by elastic deformation or bonding or any other appropriate manner.

The seal 22 may comprise a rupture zone configured to place the seal 22 manually in a removed second configuration in which the connection attaching the seal 22 to the interface panel 20 and/or to the lever 16 is broken. What that means to say is that in its second configuration, the lever 16 can be moved. For preference, removal of the seal 22 brings about irreversible disruption of the integrity thereof. What that means to say is that the seal 22 is broken and can no longer be positioned back in the first configuration.

Advantageously, the lever 16 may comprise a zone of weakness such as a local reduction in thickness to make it easier to break in the event of a knock and to limit the force transmitted to the second valve 9 (notably in the event that the lever is in its second position).

This zone of weakness of the lever 16 may notably allow the lever 16 to break in the event of a lateral impact when the corresponding valve 9 is open, without affecting the integrity of the device. After breakage, the lever 16 may maintain a residual length that allows it to be manipulated in downgraded mode (by hand or using a tool).

As visible in FIGS. 4 to 7, the first connection end 6 preferably comprises a filling coupling situated facing the interface panel 20 and this panel 20 comprises a first access opening 23 dedicated to the first connection end 6.

Likewise, the second connection end 8 may have a withdrawing coupling 18 situated facing a second opening 24 of the panel 20. This withdrawing coupling is intended to accept a complementary coupling of a withdrawing hose 17 (cf. FIGS. 4 to 6).

Figure 8:
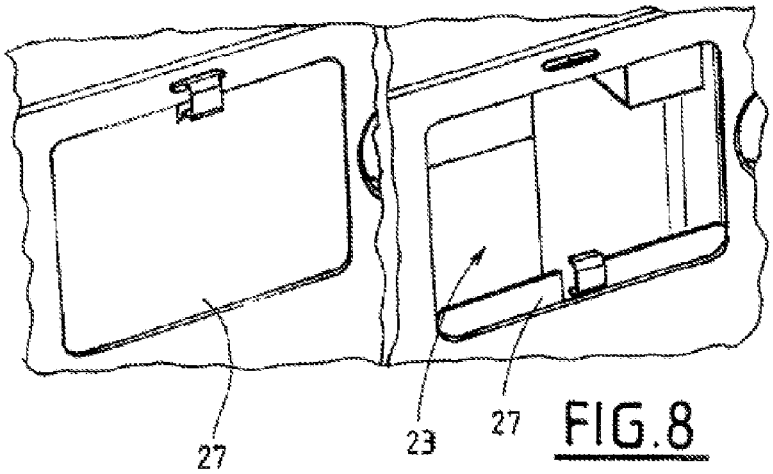
FIG. 8 depicts two perspective views of a detail of the front face of the device of FIG. 7 illustrating an opening in an interface panel in two distinct access configurations respectively.

The panel 20 may comprise at least one mobile cover 27 (for example a sliding or pivoting cover) to allow access to the first connection end 6 or second connection end 8 to be opened (cf. FIGS. 4, 5, 6 and the right-hand part of FIG. 8) or closed (cf. FIG. 7 and the left-hand part of FIG. 8) in the manner of a window.

The circuit preferably comprises a pressure gauge 26 which can be situated facing a third opening 25 of the panel 20.

As illustrated by way of example in FIG. 1, the circuit 4, 5 may comprise, positioned in series between the pressure regulator 10 and the second connection end 8, a safety relief valve 11 opening to the atmosphere when subjected to a pressure higher than a determined threshold. As illustrated in FIG. 1, the relief valve 11 is positioned downstream of the second isolation valve 9, which means to say between the second isolation valve 9 and the second end 8. Of course, as an alternative, this relief valve 11 could be positioned between the regulator 10 and the second isolation valve 9.

The safety relief valve 11 is rated for example to open a gas passage to the atmosphere when subjected to a threshold pressure of between 50 and 310 bar (or 4500 psi) and preferably of between 150 and 200 bar.

It will therefore be readily understood that the device, while being of a simple and inexpensive structure, allows the user easily to identify the various components and interfaces (couplings, valves, etc.) and to use these very ergonomically and with a high level of safety.

In particular, the interface panel 20 may clearly separate the filling and withdrawing parts of the circuit. This makes it possible to limit the risk of confusion in the connecting and actuating of the valves. To this end, the interface panel 20 may comprise zones bearing text, symbols and colors in order to make use even easier.

The cover 27 makes it possible to limit access to the filling coupling. This cover 27 limits the risk of accidental use of the first isolation valve 7. This access may be had through a deliberate action on the part of the user in the event of his having a specific requirement for a pressure or flow rate higher than the regulated-pressure valve can offer. Risks of damage and soiling are also reduced.

The interface panel 20 has the advantage, in the case of maintenance and after it has been removed, of allowing access to all of the elements involved in the use of pressurized gas thus making them easier for the operator to dismantle without him having to adopt an uncomfortable pose that is prejudicial to his limbs for example.

The invention claimed is:

1. A device for supplying gas comprising a support frame housing a plurality of pressurized-gas cylinders connected to a fluid circuit for withdrawing from or filling the cylinders, the circuit comprising a first connection end connected to the cylinders via a first isolation valve to allow filling of and withdrawing from the cylinders and a second connection end which is distinct and is connected to the cylinders via a second isolation valve and a pressure regulator so as to allow fluid to be withdrawn, the support frame comprising, on one of its faces, an interface panel comprising at least one opening providing a user access to the circuit, comprising a control member for manually operating the second isolation valve and the control member comprising a pivoting lever, and the interface panel comprises a slot providing access to the lever, said lever being mobile through the slot between a first position in which the lever is situated in the plane of the interface panel or set back therefrom within the frame volume and a second position in which at least part of the lever projects with respect to the interface panel toward the outside of the frame and through the slot.

2. The device of claim 1, wherein the lever comprises a body in the overall form of a rod the free end of which has a head that is enlarged in comparison with the rest of the body, and in that, in its second position, the head of the lever projects with respect to the interface panel through the slot.

3. The device of claim 1, wherein the slot has an overall shape corresponding to the shape of the outline of the lever.

4. The device of claim 1, wherein the device comprises a guarantee seal which, in a first configuration, has a first end fixed to the panel and a second end fixed to the lever placed in its first position, the seal in its first configuration forming an end stop preventing the lever from moving from the first to its second position, the seal comprising a rupture zone configured for manually placing the seal in a second configuration in which the connection attaching the seal to the interface panel and/or to the lever is broken.

5. The device of claim 4, wherein the seal has the form of a flat tab and comprises an end for grasping.

6. The device of claim 1, wherein the lever comprises a zone of weakness such as a local reduction in thickness to make it easier to break in the event of a knock and to limit the force transmitted to the second valve.

7. The device of claim 1, wherein the first connection end comprises a filling coupling situated facing the interface panel, said panel comprising a first opening for accessing the first connection end.

8. The device of claim 7, further comprising a mobile cover for opening or closing the first opening.

9. The device of claim 1, wherein the second connection end comprises a withdrawing coupling situated facing the interface panel, said panel comprising a second opening for accessing the second connection end.

10. The device of claim 1, wherein the circuit comprises a pressure gauge situated facing the interface panel, said panel comprising a third opening for accessing the pressure gauge.

* * * * *